United States Patent [19]

Mitter

[11] 4,109,483

[45] Aug. 29, 1978

[54] APPARATUS FOR PRINTING WEBS

[76] Inventor: Mathias Mitter, Falkenstr. 57, 4815 Schloss Holte, Fed. Rep. of Germany

[21] Appl. No.: 735,198

[22] Filed: Oct. 26, 1976

[30] Foreign Application Priority Data

Feb. 27, 1976 [DE] Fed. Rep. of Germany ..... 2608005

[51] Int. Cl.[2] ..... D06B 1/08

[52] U.S. Cl. ..... 68/200; 101/26; 118/211; 118/243

[58] Field of Search ..... 68/200, 201, 205 R; 118/211, 243, 263, 37; 101/26

[56] References Cited

U.S. PATENT DOCUMENTS

| | | | |
|---|---|---|---|
| 249,883 | 11/1881 | Boynton | 101/26 X |
| 681,121 | 8/1901 | Hudson | 101/26 |
| 1,915,779 | 6/1933 | Gere | 68/205 R |
| 3,122,039 | 2/1964 | Sowers | 101/26 X |
| 3,329,964 | 7/1967 | Mutschler et al. | 118/243 X |
| 3,683,649 | 8/1972 | Takriti et al. | 68/205 R X |
| 3,894,413 | 7/1975 | Johnson | 68/205 R |

*Primary Examiner*—Philip R. Coe

*Attorney, Agent, or Firm*—Michael J. Striker

[57] ABSTRACT

Printing medium is supplied to a plurality of individual dot-printing elements, and these elements are used for printing a pattern on a web by applying dots of printing medium from respective ones of the elements to the web, either to the surface thereof or into the depth of the same.

53 Claims, 37 Drawing Figures

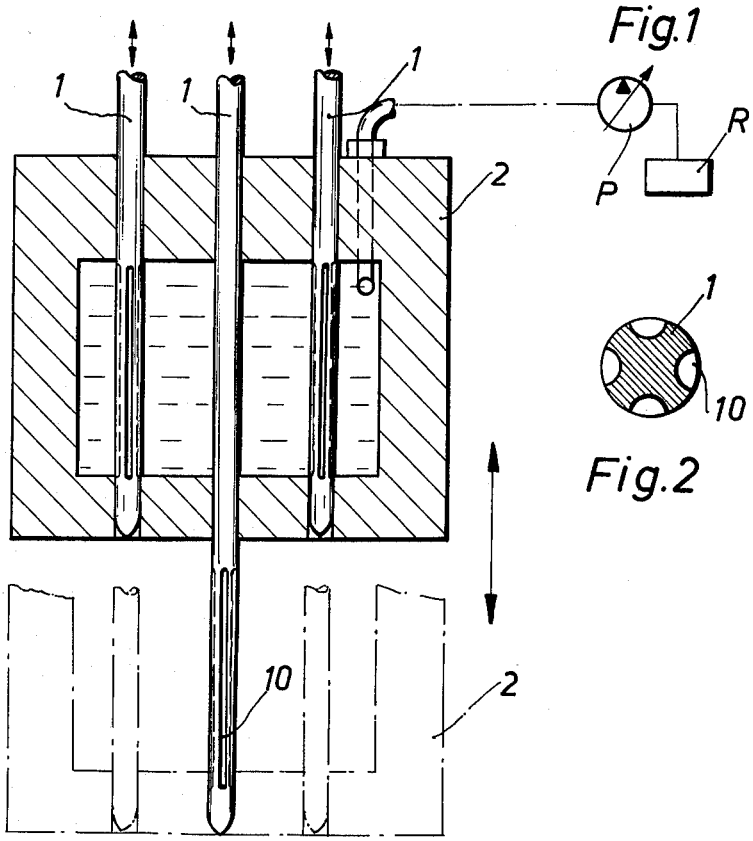
Fig.1
Fig.2
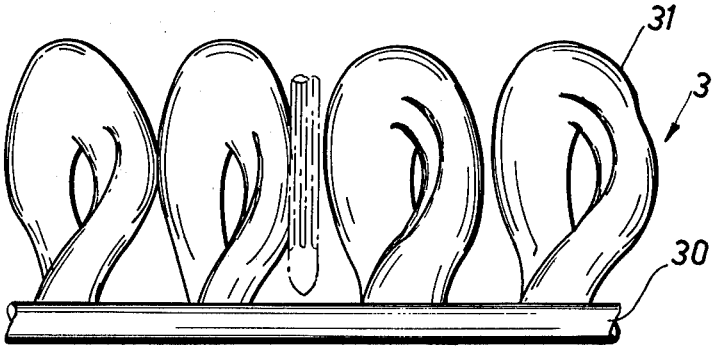
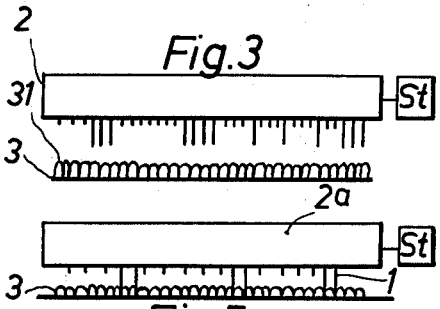
Fig.3
Fig.5
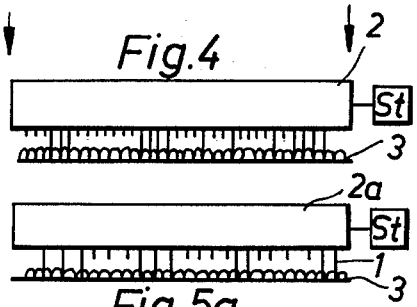
Fig.4
Fig.5a

VII
IX
St
1
2
2a
3
4
5
6
20
21
33
40
41
42
43
50
51
52
53
54
55
56
57
58
59
59a
120
150
151
159
159a
250

St
A
I

ST

I
P
R
110
a
b
c
2
110
1
1
1
XXVII
XXVII
1'
31
3
30

Fig.30
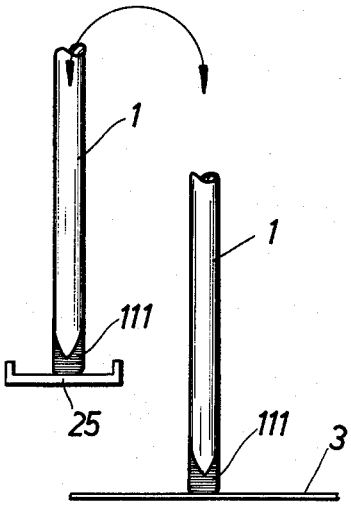
Fig.31
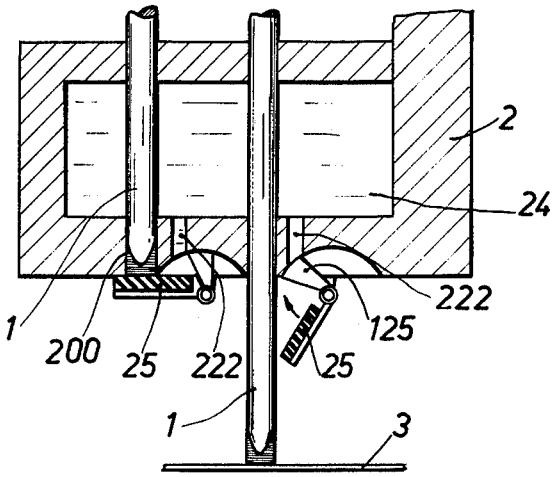
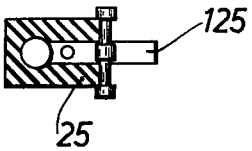
Fig.32

APPARATUS FOR PRINTING WEBS

BACKGROUND OF THE INVENTION

The present invention relates to the printing of webs, particularly but not exclusively of textile webs. More particularly, the invention relates to an apparatus for printing such webs.

The printing of webs is well known in the prior art and can be carried out in a variety of ways, for example by offset printing, by screen printing, by rotary printing or the like. In all of the prior-art proposals, however, the pattern to be printed onto the web is formed in toto on a printing element, for example in form of a plurality of perforations in a printing screen of a screen printing machine. Once the pattern is first applied, for example once the perforations are formed in the screen during manufacture of the screen, it is to all intents and purposes unchangeable and if a different pattern is to be printed, a new printing element, e.g. a new printing screen, must be installed in the mahcine.

This has very evident disadvantages, particularly in modern times in which a large and rapid change in the types of patterns is desired, and is often dictated by rapid changes in fashion. Under these circumstances, the necessary change of the printing element for each change of the pattern to be printed, results in an enormous increase in operating costs. Moreover, in view of the fact that a complete change-over of the printing element is so expensive, e.g. a printing screen with a new pattern costs approximately $25,000.00 or more, an economically viable manufacturing operation is possible only if large or very large quantities of webs are to be printed with one and the same pattern. In operations in which relatively small quantities of webs are to be printed, which occurs often in the present-day fashion climate, the purchase costs of obtaining a different printing element for each different pattern to be printed, are often completely prohibitive.

All prior-art printing methods can basically be subdivided into two categories, namely rotary printing and flat printing. In all of these applications the disadvantages outlined above obtain fully and without reservation. If the pattern is to be changed, then the printing element must be replaced with a different one. If some correction in the pattern is to be carried out, which occurs relatively frequently, but is not of such magnitude that the whole printing element must be replaced, then extremely complicated manual labor must be performed to carry out the correction, which is again highly labor- and cost-intensive and severely depresses the economic feasibility of the operation.

It has been proposed in the prior art to spray printing medium onto the workpiece web from nozzles. However, according to this proposal the printing medium must be atomized and once it leaves the nozzles is completely uncontrolled. This means that the printing medium impinging the workpiece web can at best produce a very rough pattern but will not, however, be able to produce an exact pattern or contour. The material produced in this way is of very inferior quality and is not acceptable to quality-oriented consumers.

SUMMARY OF THE INVENTION

Accordingly, it is an object of the present invention to overcome the disadvantages of the prior art.

More particularly, it is an object of the present invention to provide a novel apparatus for printing webs, wherein the disadvantages of the prior art are avoided.

Another object of the invention is to provide such an apparatus which does not require a large-surface printing element or pattern carrier, as is e.g. necessary in screen printing machines or in machines using printing rollers. An additional object of the invention is to provide such an apparatus wherein the pattern can be varied at any time and completely at the will of an operator, without any difficulty at all.

In keeping with the above objects, and with others which will become apparent hereafter, one feature of the invention resides in an apparatus for printing webs, particularly textile webs, wherein printing medium is supplied to a plurality of individual dot-printing elements, and thereupon is printed a pattern on a web by applying dots of printing medium from respective ones of the elements to the web.

The dot-printing elements can be used individually for printing, or they can operate in groups. What is important is the fact that each one of the elements can selectively be operated to print or not to print, i.e. it can either individually be made to print or not to print or it can be associated selectively with other elements to form a group which is then made to print. The composition of the groups can be changed readily, since any desired dot-printing elements can be added to or withdrawn from the group.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a somewhat diagrammatic vertical section, illustrating the principle of the invention on hand of a simplified embodiment;

FIG. 2 is a cross section through one of the dot-printing elements of the embodiment in FIG. 1, illustrating one possible cross-sectional configuration of such an element;

FIG. 3 is a side view of FIG. 1, showing one operative position;

FIG. 4 is the same view as FIG. 3, but showing another position;

FIG. 5 is a view similar to FIG. 3, but illustrating a somewhat different embodiment;

FIG. 5*a* shows the embodiment of FIG. 5 in a different operating position;

FIG. 30 is a fragmentary diagrammatic side view, illustrating the operating principle according to a further embodiment of the invention;

FIG. 31 is a vertical section through an additional embodiment of the invention;

FIG. 32 illustrates a detail of FIG. 31;

DESCRIPTION OF THE PREFERRED EMBODIMENTS

Figures 6, 7, 8, 9:
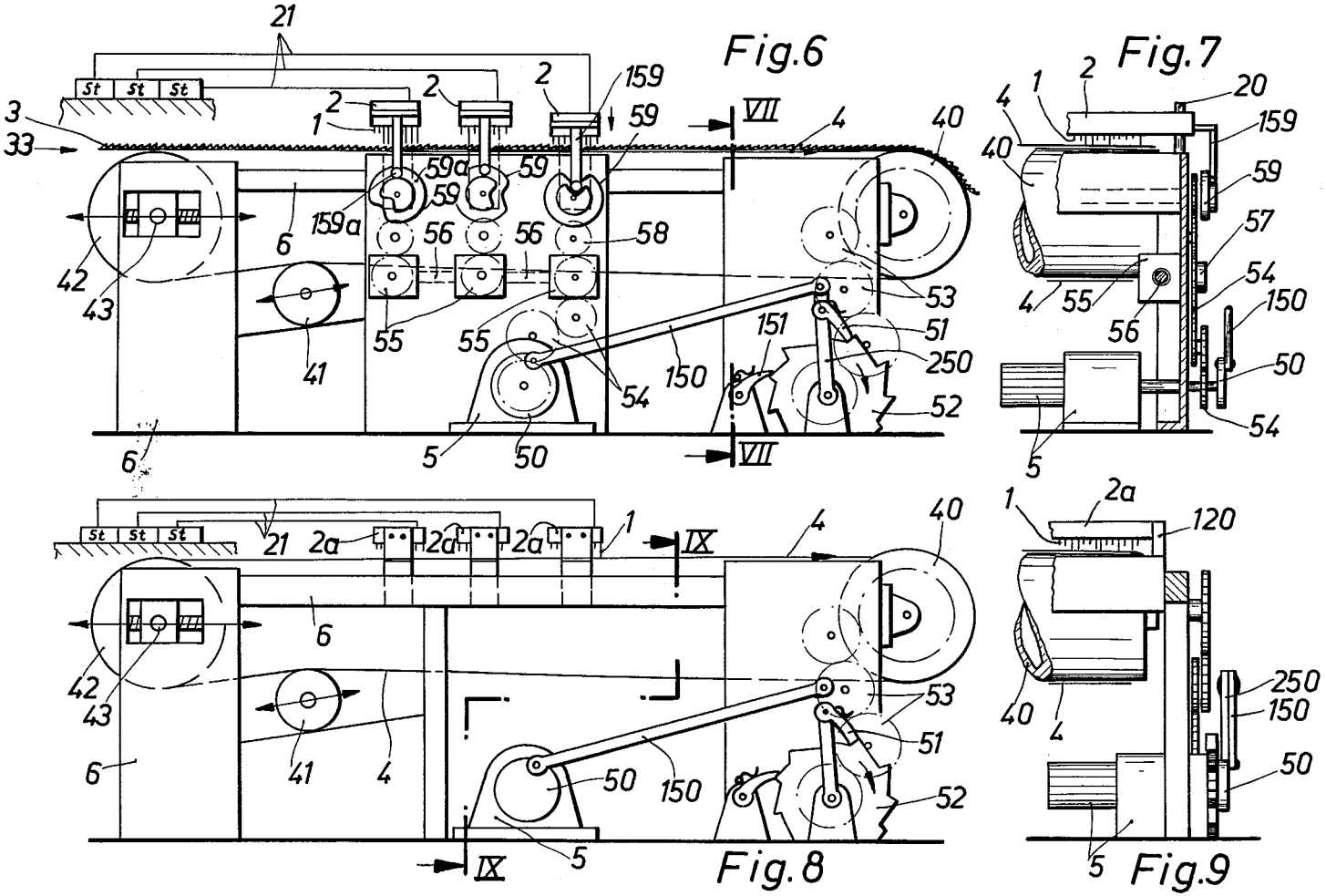
FIG. 6 is a somewhat diagrammatic side view of a printing machine according to the present invention.
FIG. 7 is a section taken on line VII—VII of FIG. 6.
FIG. 8 is a view similar to FIG. 6, but illustrating a different embodiment of the invention.
FIG. 9 is a section on line IX—IX of FIG. 8.

Discussing now the drawing in detail, and referring firstly to FIGS. 1 and 2 thereof, the invention will be discussed by way of example and for explanatory purposes on hand of FIGS. 1 and 2.

The invention proposes to utilize a plurality of dot-printing elements 1, which may be in the form of needles as illustrated in FIGS. 1 and 2. These receive printing medium, such as printing ink or the like, in any suitable manner, for example by dipping into a bath of such medium or by travelling through a container which accommodates a bath of such medium, for example by travelling through apertures in a supporting beam 2 which accommodates the bath of such medium. They can be controlled for movement up and down in the direction of the double-headed arrows, the control to be effected in any suitable manner. They need not be reciprocable in absolutely vertical direction, but could be reciprocated in an inclined direction or even a horizontal direction. Reciprocating them in vertical direction does, however, have the advantage in terms of transferring printing medium to the web 3 to be printed, that the printing medium does not have any tendency to escape in lateral direction onto or into the printing medium but instead tends to run through the nap 31 (a section of web is here shown as a section of carpet to be printed) towards the base fabric 30.

As pointed out before, there is a variety of ways in which a printing medium can be supplied to the dot-printing elements 1. The possibilities are not by any means limited to those which have already been described. Instead, printing medium could be sprayed onto the dot-printing elements 1 from laterally thereof, printing-medium transfer wheels could engage them laterally and transfer printing medium to them, or other possibilities could be employed. It is, however, advantageous if the printing elements 1 either have internal hollows provided with openings communicating with their exterior, or else if their circumference is formed with one or more longitudinally extending grooves of flutes 10 (see FIG. 2), in which printing medium can be retained preparatory to transfer to the web 3. If, for example, the support beam 2 is provided with an internal hollow as illustrated, which accommodates a bath of printing medium as shown, then the flutes 10 will fill with the printing medium as the printing elements 1 reciprocate through the bath and as they extend out of the bath and to the web 3 (see the broken-line illustration of one of the elements 1) this printing medium from the flutes 10 is then yielded up to the web 3, particularly as subsequently the printing element is withdrawn upwardly again out of contact with the web. Since a large number of such printing elements 1 are located adjacent one another, as for example shown in FIG. 3, a correspondingly large number of colored dots are applied to the web 3 and the web 3 can be completely covered with colored dots of different colors and/or arranged in any selected pattern, so that even very highly complicated patterns can be produced.

FIGS. 3 and 4 show diagrammatically how the apparatus of FIGS. 1 and 2 operates. The support beam 2 can itself be raised and lowered relative to the web 3. In addition each support beam 2 is provided with a control unit ST which controls the upward and downward reciprocation of each dot-printing element 1 individually so that very precisely selected patterns can be printed when the beam moves from the upwardly retracted position of FIG. 3 to the printing position shown in FIG. 4.

However, as FIGS. 5 and 5*a* show, it is also possible for the beam 2*a* to remain completely stationary and for the individual dot-printing elements 1 to be raised and lowered by the control unit St. They can be made to contact the upper surface of the web, in this case the upper surface of the nap 31 thereof, they can be made to enter between the nap 31 as for example shown also in FIG. 1, or they can even be made to penetrate into the base fabric 30.

The beams 2 themselves can be mounted on carriages which can travel lengthwise and/or transversely of the web 3 if the latter is maintained stationary during the printing operation, or else the web 3 can be transported continuously or discontinuously, and the carriage with the beam or beams 2 or 2*a* can be made to move only transversely, or transversely as well as lengthwise of the web 3.

A concrete embodiment of an apparatus according to the present invention, wherein the web 3 is to be discontinuously transported, is shown in FIGS. 6 and 7. In this embodiment there are provided three of the supporting beams 2. These are arranged above the working plane 33 in which a conventional endless printing blanket 4 has its upper run located, the run travelling in the direction towards the right of FIG. 6. The web 3 is supported on the upper run of the printing blanket 4 to be transported with the same. The printing blanket 4 is driven by a main roller 40 which entrains the endless printing blanket 4. The latter is guided over a tension regulating roller 41 and returns to an upstream reversing roller 42 that is provided with a tension regulating device 43 forming no part of the invention and being conventional in this art. The printing blanket 4 itself can have an upper surface which is either smooth, corrugated or provided with needles. Other possibilities also exist and can be utilized, but none of them form a part of the invention.

The printing blanket 4 is intermittently driven in clockwise direction by a main drive 5, a pawl 51 and a cooperating wheel 52, and a transmission 53 which transmits rotary motion to the main printing blanket drive roller 40. Each step by which the printing blanket 4 is incrementally advanced can be selected in accordance with the wishes of the designer as to the desired length. For example, each step may be as short as one-half of a millimeter or may be much greater.

The supporting beams 2 are movably mounted and are driven from the main drive 5 via transmissions 54 which transmit motion to an angle drive 55. From the first angle drive motion is then transmitted to the other printing stations either via a rigid shaft or via an articulated shaft 56, as in the present case. Motion is transmitted from the angle drive 55 via a coordinating drive 57 and a transmission 59 to a respective rotary cam 59. The configuration of the cam track on the cam 59 determines the length of the (here vertical) stroke to be performed by the respective supporting beam 2. The purpose of the device 57 is to coordinate the movement of the beams 2 with the stepwise intermittent movement of the printing blanket 4. This can be achieved in various ways, for example by rotating a gear or the like at an appropriate timing sequence.

Each of the supporting beams 2 is provided with a plurality of individual dot-printing elements 1 which are controlled by the control units St, one for each supporting beam 2. The control units St may operate in computer fashion and can each control the movements of all of the dot-dash printing elements of the respective supporting beam 2, the movement of each of the elements 1 being controlled individually. The control units St may be provided with comparison arrangements which compare the instantaneous position of the respective dot-dash printing elements 1 with a predetermined program. Computer devices suitable for use as the control units St are made by various firms; Hewlett-Packard furnishes such as computer in its "Scitex Response System", Dr.-Ing. Rudolf Hell GmbH of Kiel, Germany, furnishes another suitable computer (made by Siemans, Erlangen, Germany) in its "Patroscan System", Sulzer Morat GmbH of Stuttgart, Germany, furnishes a suitable computer in its "Scan System" and another suitable computer is available from Deering-Milliken of Spartansburg, S.C. in the firm's "Milliken System".

In operation, the intermittently advancing printing blanket 4 equally intermittently advances the web 3 in clockwise direction (FIG. 6) beneath the respective printing station, i.e. beneath the supporting beams 2 which are each located at one of the printing stations. When the beams 2 are in the upper or raised position (compare the two left beams in FIG. 6) the dot-dash printing elements 1 of the respective beams are preselected as to whether they are to operate or not for printing purposes, by operation of the associated control units St. As thereafter the cams 59 rotate, the rods 159 whose cam followers 159*a* are received and guided in grooves 59*a* of the cams 59 so that they cannot separate therefrom, pull down the respective supporting beams 2 so that the preselected printing elements 1 (i.e. those which project downwardly beyond the respective beam 2) transmit dots of printing medium to the workpiece web 3. During continued rotation of the cams 59 the beams 2 are then pushed upward again via the cam followers 159*a* and the rods 159. A drive 5 controls the intermittent advancement of the printing blanket 4 and the web 3 via the crank 50, 150, the end of the crank 150 carrying an arm 250 which carries the pawl 51. A further pawl 151 prevents a reverse movement of the wheel 52. Each of the supporting beams 2 has its own vertical guide 20 at its opposite axial ends, one of which is shown in FIG. 7.

FIGS. 8 and 9 show an embodiment which essentially corresponds to that of FIGS. 6 and 7. The machine frame 6 differs from that in FIGS. 6 and 7, but this difference is not a part of the invention and is of no consequence for the same. The basic difference between FIGS. 8–9 as compared to FIGS. 6–7 resides in the fact that the supporting beams 2*a* are not vertically reciprocable. Instead, they are stationary in the illustrated positions and are not provided with the vertical guides 20. In FIGS. 8 and 9 the reciprocation of the dot-dash printing elements 1 is not preselected in an upper position of the beams 2*a*, but instead the control unit St selects the respective dot-dash printing elements and makes them move directly into engagement with the web 3 being printed. The sequence of dot-dash printing performed by the respective elements 1 can therefore vary constantly. The supporting beams 2*a* are mounted on fixed supports 120 (one shown in FIG. 9) arranged at the axial ends thereof. The control units St are connected with the beams 2*a* via appropriate connecting elements 21 which, depending upon the control medium being used, i.e. electricity, compressed air or the like, may be electrical conductors, tubes or the like.

Figures 10, 11, 12, 13:
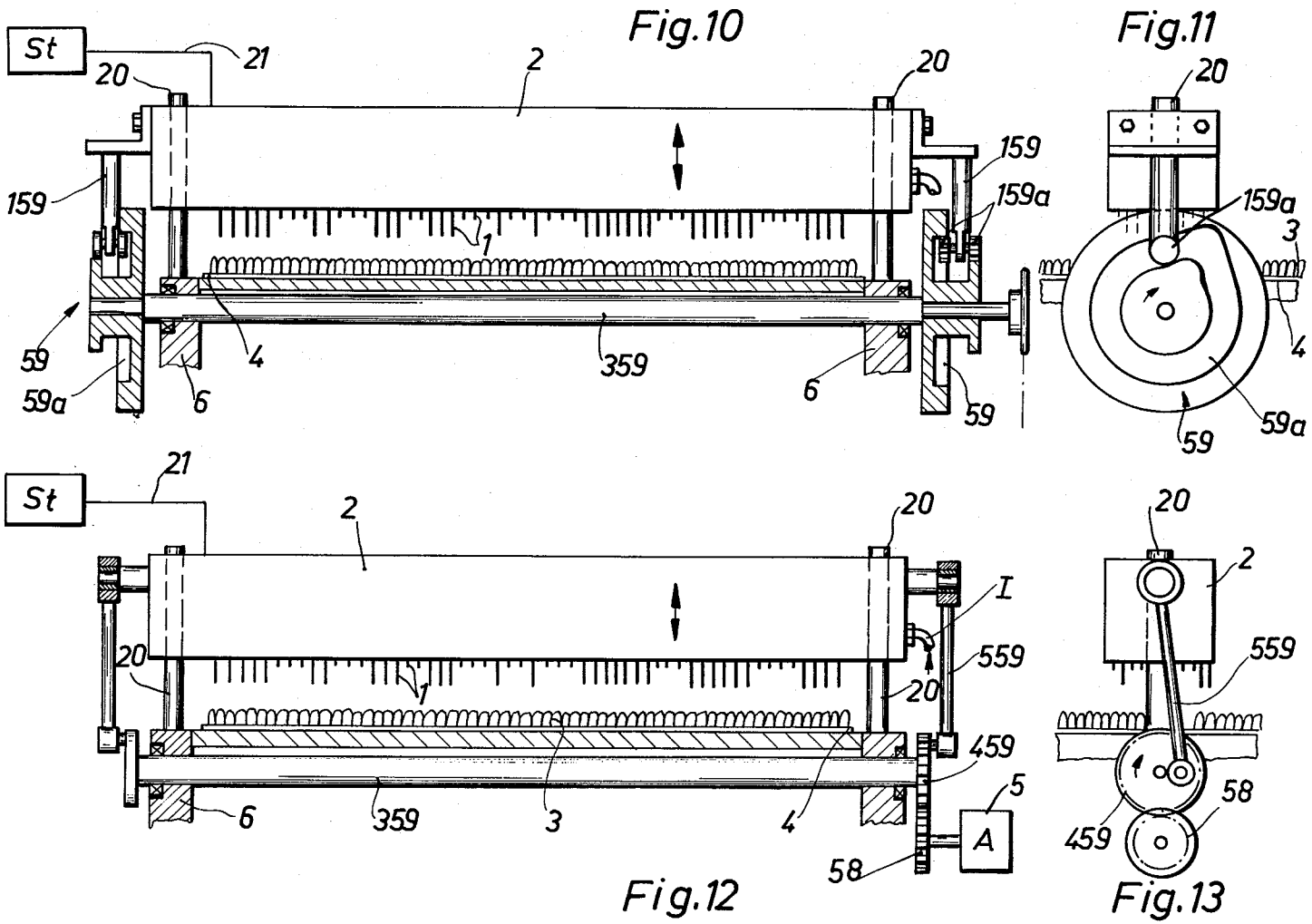
FIG. 10 is a side view, partially in section, illustrating a possible drive of a component of one of the machines in the preceding embodiments.
FIG. 11 is a view of FIG. 10, looking towards the left.
FIG. 12 is a view similar to FIG. 10, illustrating a further embodiment.
FIG. 13 is a view of FIG. 12, looking towards the left.

FIGS. 10 and 11 show one possible control arrangement for the beams 2 in more detail. The beams 2 again have the end guides 20 as described with respect to FIGS. 6 and 7. The rods 159 and the rotary cams 59 have already been described with reference to FIGS. 6 and 7, as have been the cam followers 159*a* and the grooves 59*a*. These arrangements are provided at both axial ends of the beams 2, and the cams 59 at the two axial ends may be connected with one another by means of a shaft 359 so that only one of the cams 59 need be driven in order to also drive the other one in synchronism. The operation of the arrangement has already been described with reference to FIGS. 6 and 7.

FIGS. 12 and 13 show a different control arrangement which does not utilize the rotary cams 59 and the associated components. Instead, crank wheels 459 are employed in conjunction with crank rods 559. The crank wheels 459 can be constructed as gears, as shown in FIG. 12, and may be driven by the transmission 58. The crank wheels 459 at the opposite axial ends of the beams 2 may again be connected by a shaft 359 for rotation in synchronism Control units St control via tubes or conductors 21 the mechanisms located in the interior of the beams 2, which mechanisms effect the vertical reciprocation of the dot-dash printing elements 1. The interior of the beams 2 may be so constructed as shown in FIG. 1, i.e. it may be hollow and accommodate a bath of printing medium which can simply be poured into the hollow interior or which can be supplied by means of suitable (not illustrated) pumps via an inlet tube I (compare FIG. 12). As described with respect to preceding Figures, the preliminary selection of which of the elements 1 is to print during a downward reciprocation of the respective beam 2, takes place when the beam is in the upper position (as shown in FIG. 12) and each time when the beam 2 again returns to its upper position the particular elements 1 which are to print during the next downward reciprocation can be changed again; of course, they can also remain the same, as desired.

Coming to the embodiments of FIGS. 14–19 it will be seen that these illustrate apparatuses according to the present invention in which the supporting beams themselves do not have compartments for printing medium. In these embodiments there are provided separate printing-medium receptacles 7 with medium-stripping plates 70 extending over their upper open tops and provided with bores or apertures 71 through which the respective elements 1 can enter so as to dip into the bath of printing medium in the interior, excess printing medium being stripped off as the elements 1 are upwardly withdrawn through the apertures 71.

Figures 14, 15, 16, 17, 18, 19:
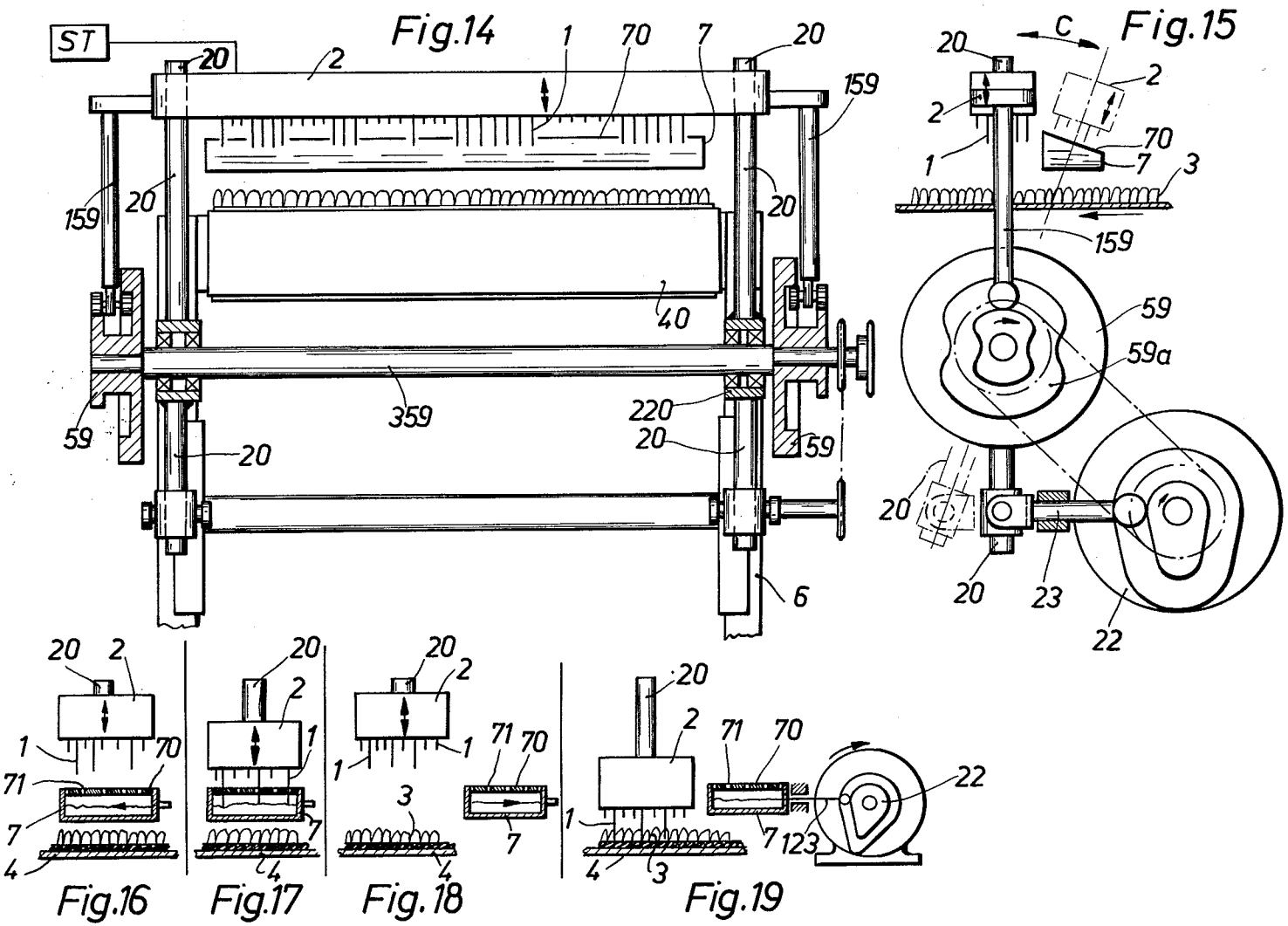
FIG. 14 is a side view illustrating another embodiment of the invention.
FIG. 15 is an end view of FIG. 14, looking towards the left.
FIG. 16 is a diagrammatic side view, illustrating a further embodiment of a drive for use in the apparatus according to the present invention, in one operating position.
FIG. 17 shows the drive of FIG. 16 in a different operating position.
FIG. 18 shows the drive of FIGS. 16 and 17 in still a further operating position.
FIG. 19 shows the drive of FIGS. 16–18 in another operating position.

The embodiment in FIGS. 14 and 15 corresponds basically to that in FIGS. 6 and 7. However, the vertical guides 20 at the opposite ends of the beams 2 are not fixedly mounted on the machine frame 6, but are instead pivotably mounted on the shaft 359 which carries the rotary cams 59, via pivot bearings 220 located at the opposite axial ends of the shaft 359. The vertical guides 20 extend upwardly from the pivot bearings 220 and are entrained by a rod 23 via a cam 22 and pivoted in the direction of the arrows C (see FIG. 15). It goes without saying that the operation of the cams 22 and 59 must be so coordinated that the cams 59 draw the associated supporting beams 2 downwardly twice during each operating cycle, namely once in the broken-line position shown in FIG. 15 so that the previously selected elements 1 dip into the bath of printing medium in the receptacle 7, and thereupon for the second and subsequent time when the beam 2 is in the solid-line position shown in FIG. 15, so that the now inked elements 1 print the web 3. Each of the beams 2 is thus alternately moved to the broken-line position and thereupon to the solid-line position, then reciprocated downwardly so that the selected elements 1 print onto the web 3, whereupon it is moved upwardly again and the sequence of operation begins all over.

FIGS. 16–19 show a further embodiment which utilizes a different possibility of inking the printing elements 1 by dipping them into a bath of printing medium. The supporting beam 2 is shown only diagrammatically in these FIGURES and its movement is controlled via its vertical guide 20 and the cam track 59 in the sequence which is evident from FIGS. 16–19. FIG. 16 shows the starting position in which the beam 2 is in the upper position wherein the printing elements 1 to print during the next sequence are selected. Via a cam 22 which is connected by a rod 123 to the printing medium container 7 (shown only once in FIG. 19 for the sake of orientation) the printing medium container 7 is moved from the position shown in FIG. 19 to the position shown in FIG. 16 in which it is located beneath the respective beam 2. As shown in FIG. 17, the beam 2 is then reciprocated downwardly until the preselected elements 1 dip through the cover plate 70 (and through the opening 71 thereof) into the bath of printing medium in the container 7. Thereupon the beam 2 is raised again as shown in FIG. 18 and the printing medium container 7 is laterally retracted, and finally as shown in FIG. 19 the beam 2 is reciprocated downwardly until the ink-carrying end portions of the selected elements 1 print onto the web 3.

It should be understood that in this embodiment, as in all others herein, the concepts of the invention are fully applicable even if the printing blanket 4 is replaced with a work table 40, or with a counterpressure beam of the type that is conventionally used in screen printing machines and on which the workpiece 3 would be supported.

Also, in FIGS. 16–19 as indeed in all other embodiments of the invention disclosed herein, the elements 1 need not be selected singly for printing, but can also be selected in groups whose size and composition can be varied by adding or subtracting individual ones of the elements 1.

Figure 20:
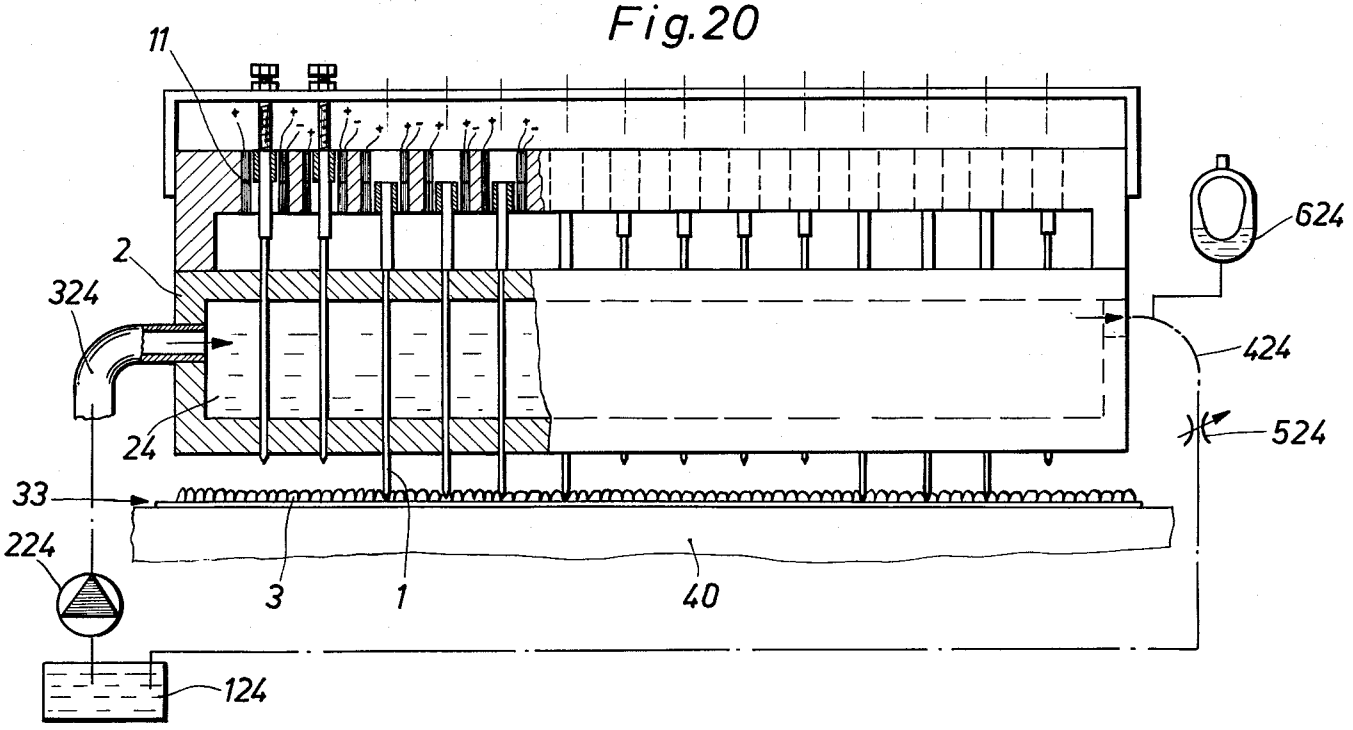
FIG. 20 is a somewhat diagrammatic, partially sectioned side view illustrating one possible embodiment for applying printing medium in the apparatus of the present invention.

FIG. 20 shows a further embodiment of the invention utilizing a supporting beam 2 of the type shown for example in FIG. 1, i.e. which has an interior that is hollow and can accommodate a body 24 of printing medium, such as viscous printing ink. The admission of the printing medium is effected via a conduit 324 that communicates with a pump 224 which draws printing ink from a reservoir 124 and supplies it via the conduit 324 into the interior of the beam 2. Excess printing ink is recirculated via a recirculating conduit 424 that communicates with the interior of the beam 2 and also with the reservoir 124. An adjustable throttle 524 is interposed in the conduit 424 so that the body 24 in the interior of the beam 2 may be pressurized to a desired pressure. A pressure storage device 624 may also communicate with the conduit 424, e.g. in form of a bladder filled with gas and accommodated in a receptacle into which some of the printing ink or medium can escape and cause compression of the bladder, the purpose of the device 624 being to maintain a constant pressure in the body 24 of printing medium in the supporting beam 2. The pump 224 is advantageously of the type that can be continuously adjusted, i.e. that can be adjusted steplessly, and the conduit 324 is advantageously flexible, i.e. in form of a flexible hose.

In the embodiment of FIG. 20 I have illustrated means for individually selecting the printing elements 1 which are to operate during a given printing operation. The elements 1 are selected and controlled by magnets 11, here solenoid magnets which will be described later as to their operation. The elements 1 pick up printing medium as they travel through the body 24 and their tips seal the outlet openings in the lower side of the beam 2 as long as the elements 1 are in the retracted position shown in FIG. 20. When they are extended downwardly (compare the three shown at the right-hand side of FIG. 20) they take along printing medium which is transferred to the web 3 in form of individual dots of color.

Figure 21:
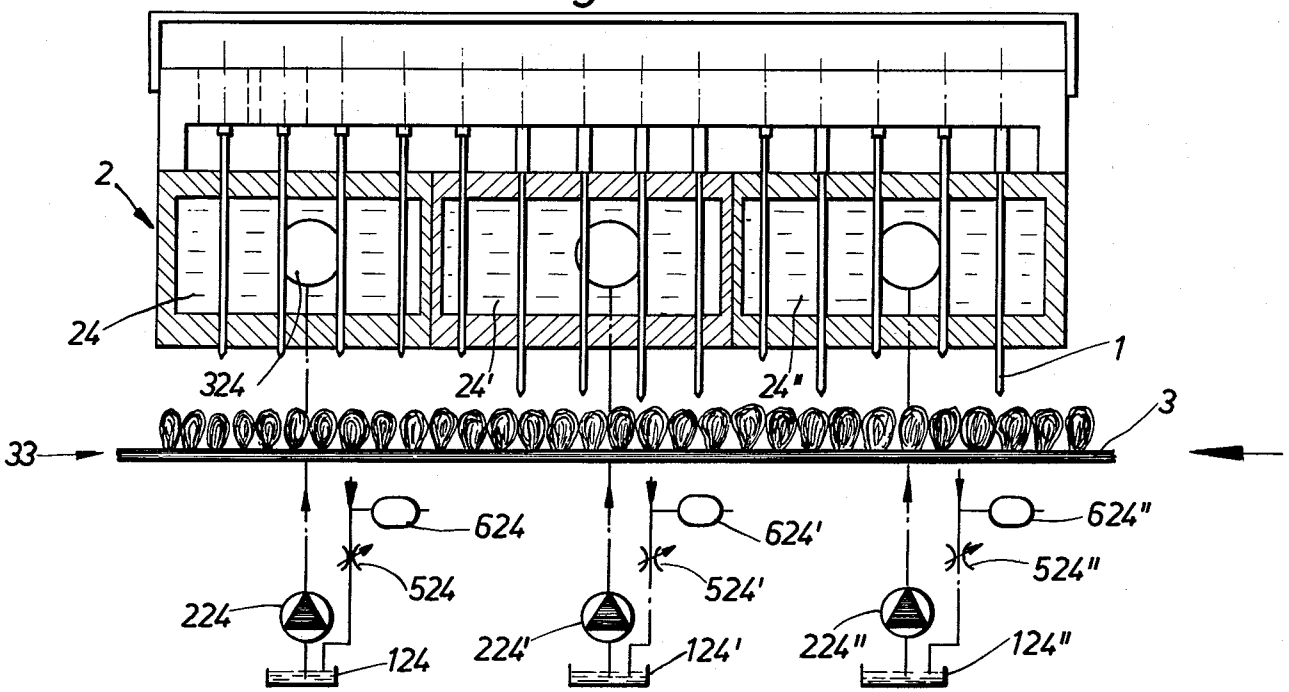
FIG. 21 is a view similar to FIG. 20, showing another embodiment for use in case of multi-color printing.

Another embodiment of the invention is shown in FIG. 21 and illustrates how a plurality of the beams 2 can be united (e.g. by means of the diagrammatically illustrated screws or the like) to form a compact unit. This unit saves mechanical cost for driving the beams 2 individually and of course requires less space than if the beams 2 were to be mounted and operated separately. Each of the beams accommodates a body 24, 24', 24" of printing medium, and the printing medium may be of different colors in the different beams 2. Each beam 2 has associated with it a separate pump 224, 224' and 224", respectively, a separate reservoir for printing medium 124, 124' and 124", a separate throttle 524, 524' and 524", and separate pressure reservoirs 624, 624' and 624". The pressure reservoirs 624, 624' and 624" correspond in their construction and purpose to the reservoir 624 described with reference to FIG. 20. It is evident that fewer or more than the illustrated three beams 2 may be connected to operate as a unit.

Figure 22:
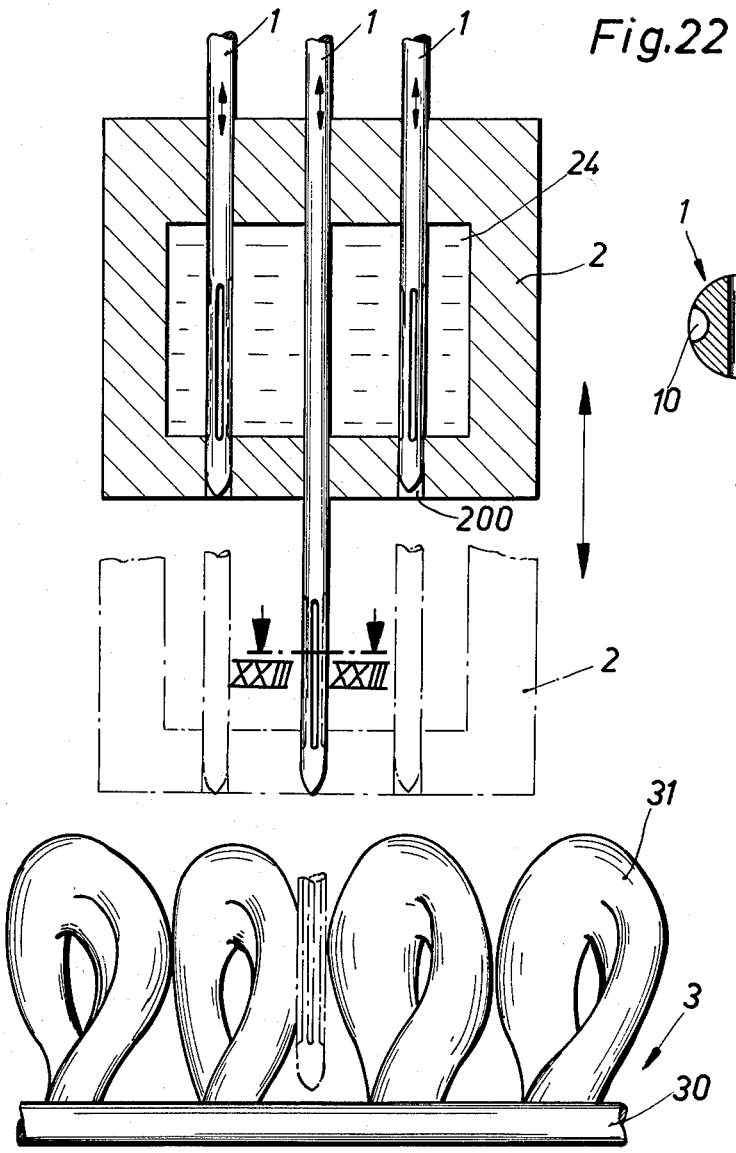
FIG. 22 is a view similar to FIG. 1, illustrating an apparatus having dot-printing elements constructed differently from those in FIG. 1.
Figure 23:
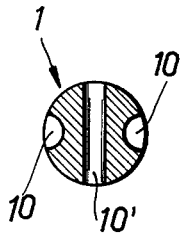
FIG. 23 is a section on FIGS. XXIII—XXIII of FIG. 22.

Coming now to FIGS. 22 and 23 it will be seen that in these I have illustrated a particular construction of the printing elements 1. In all other respects, the embodiment of FIGS. 22 and 23 corresponds to that of FIGS. 1 and 2. The printing elements 1, however, are here provided with axially extending grooves or recesses 10 for accommodation of printing medium. In addition, each printing element 1 is provided with a medium-accommodating space 10' which corresponds to the eye of a needle, i.e. which extends from one to an opposite side of the respective element 1 and is open at these sides. The elongation of the ink spaces 10, 10' lengthwise of the elements 1 is relatively significant, as an inspection of FIG. 22 will show. If the web 3 to be printed is a textile fabric having a nap, then it is advantageous if the axial length of the spaces 10, 10' corresponds at least approximately to the height 31, as shown in FIG. 22. If the printing medium is an ink which has relatively low viscosity, then the lower end portion of the respective element 1 must be free of the spaces 10, 10' so that it can serve to seal the outlet bores 200 in the lower surface of the respective beam 2 when the elements 1 are in the upper retracted position, to prevent uncontrolled escape of the ink from the body 24 and onto the web 3.

Figures 24, 25:
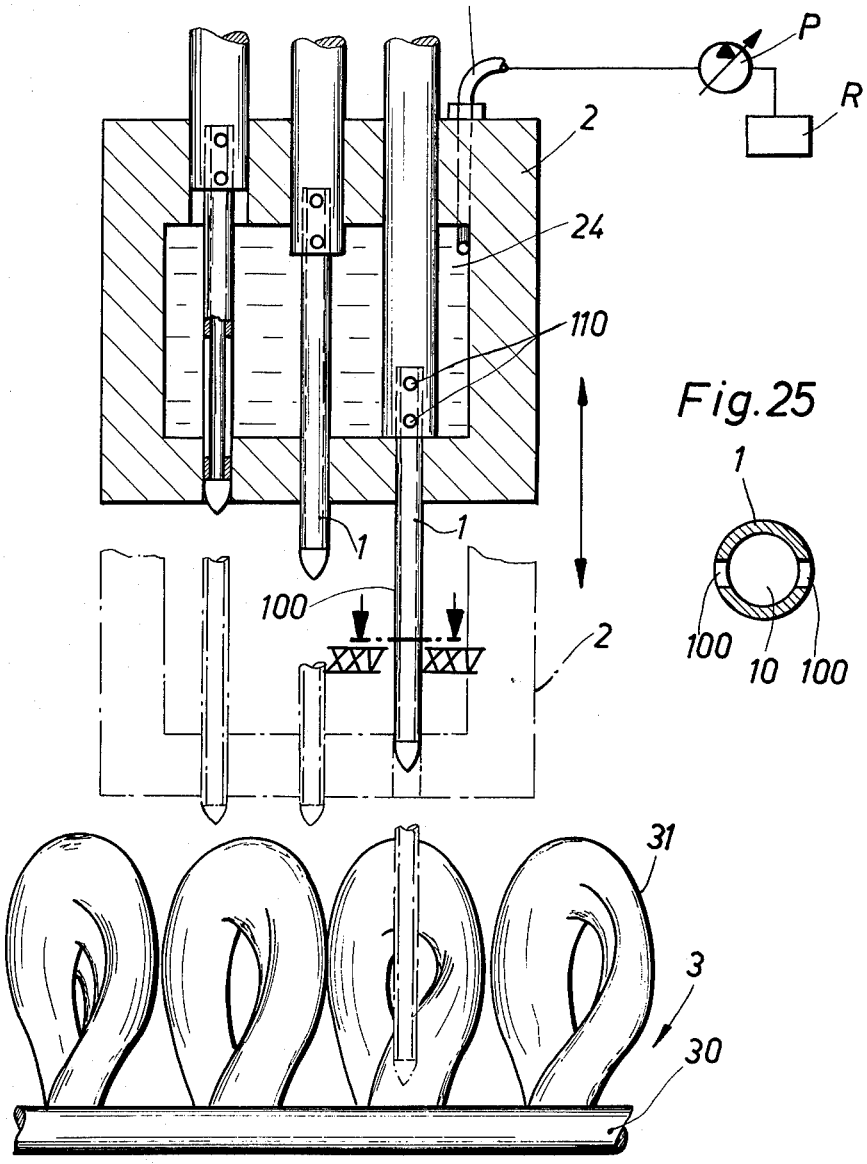
FIG. 24 is a view similar to FIG. 22, illustrating a further embodiment.
FIG. 25 is a section on XXV—XXV of FIG. 24.

A further embodiment is shown in FIGS. 24 and 25. It, also, corresponds essentially to that in FIGS. 1 and 2 and differs therefrom in the particular configuration of the elements 1. In FIGS. 24 and 25 the elements 1 are hollow and have in their interior a rather large ink space 10*a* which communicates with the exterior of the respective element 1 through elongated slots 100 in the circumferential wall of the element 1. The lower ends of the elements 1 are solid, so that they again can seal the apertures 200 when they are in the upper retracted position. The elements are shown in different positions relative to the beam 2, and one of them is shown in broken lines as having entered into the nap 31 of the web 3.

Figures 26, 27:
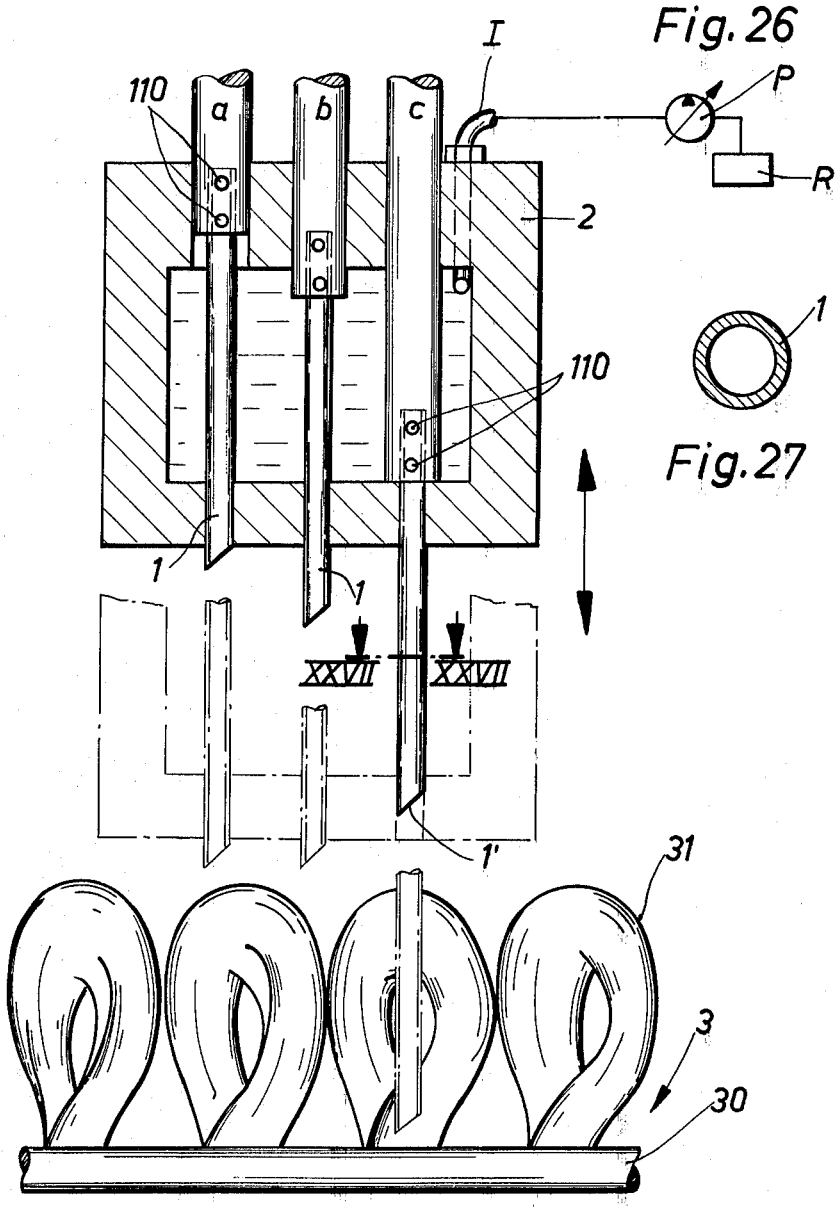
FIG. 26 is a view similar to FIG. 24, illustrating another embodiment of the invention.
FIG. 27 is a section taken on line XXVII—XXVII of FIG. 26.

Instead of simply transferring dots of printing medium, such as ink, to the web 3, the elements 1 can also be used to inject dots of printing medium directly into the web 3. This is shown by way of example in FIGS. 26 and 27 where the elements 1 are hollow tubes having a lower end portion which is cut off at an angle to the axis of the respective element 1, as shown at 1', so as to facilitate entry into the web 3. The leading ends 1' are open, and at the trailing ends where the elements 1 are mounted in support members *a*, *b* and *c*, respectively, transverse bores are provided through which ink can enter from the interior of the beam 2 into the respective elements 1. The beam 2 extends transverse to the direction of movement of the workpiece 30 and the center one of the elements 1 is shown during its movement between the two end positions shown by way of the lefthand one and the right-hand one of the elements 1. The time required for each element to move from one to the other of these end positions is limited to fractions of a second, so that no ink can escape during the movement of the respective element 1.

As shown in FIGS. 22, 24, 26 and 28, but applicable also to other embodiments, the ink is supplied under pressure into the beam(s) by being pumped via a pump P from a respective reservoir R.

Figures 28, 29:
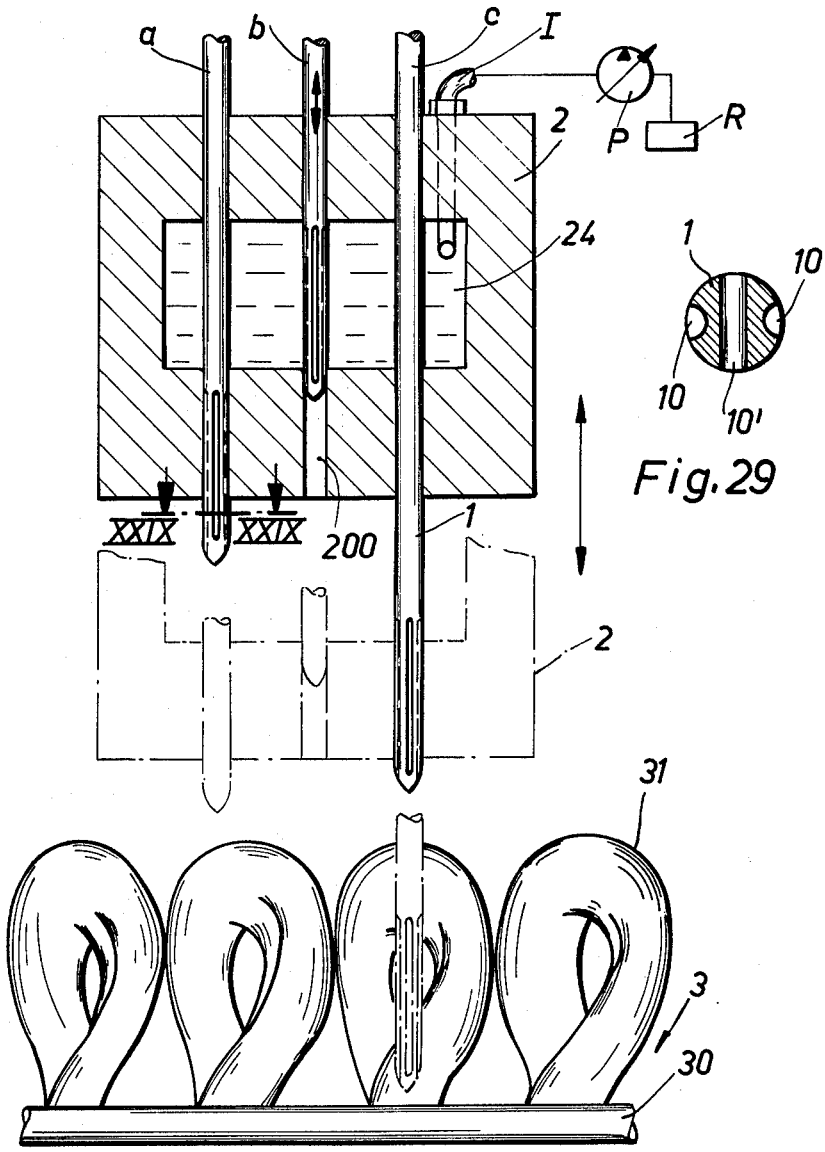
FIG. 28 is a view similar to FIG. 26, illustrating an additional embodiment of the invention.
FIG. 29 is a section on line XXIX—XXIX of FIG. 28.

FIGS. 28 and 29 illustrate a further embodiment which is reminiscent of the embodiment of FIGS. 22 and 23. It differs from the same essentially in that three positions are possible for the elements 1, namely the position *a* which is the rest position, the position *b* which is the ink pick-up position and the position *c* which is the ink transfer or printing position. The elements 1 again have the configuration as shown in FIGS. 22 and 23, i.e. they have the grooves 10 and the interior space 10'. In position *a* the respective element 1 is at rest since so pick-up or discharge of ink can take place, in position *b* ink is picked up in the spaces 10, 10' and in position *c* ink can be discharged to the web 3. Similar positions have also been shown with respect to FIGS. 26 and 27.

FIGS. 30, 31 and 32 show a different manner of printing onto a web 3. Here, the transfer of ink from a reservoir in the beam 2 which contains a body 24 of ink, is not directly to the elements 1. Instead, as shown by way of the diagrammatic explanation in FIG. 30, transfer takes place in the manner of inking of a stamp. Namely, the free end of the respective element 1 contacts the inked "stamp cushion" 25, i.e. an element which operates analogously to such a cushion, and picks up ink which is then transferred to the web 3. This can be effected with an arrangement similar or analogous to the one shown in FIGS. 14–19, or in the manner shown in FIG. 31.

FIG. 31 shows in particular that the free ends of the elements 1 carry a member 111 which in effect is a stamp tip. Such a tip 111 can print onto paper, fabric, leather or other webs, since a direct point-transfer of color takes place and no yielding-up of liquid ink per se out of ink-containing spaces. The vertical reciprocation of the beam 2, as well as the selection and operation of the elements 1 themselves, takes place as in the preceding embodiments. Here, however, the free ends of the vertical bores in the lower wall of the beam 2, which bores are identified with reference numeral 222, are closed by a stamp pad 25 which is spring mounted and is permanently urged against the lower ends 200 to close the same. Ink is in permanent contact with the pads 25 through the bores 222 and a lever 125 closes the bores 222 as long as the members 1 are downwardly extended, as shown by way of the right-hand member 1 in FIG. 31. FIG. 32 shows the construction of one of the pads 25 in detail.

Figure 33:
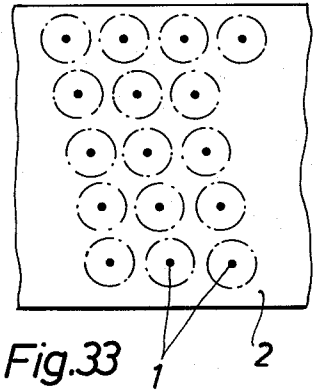
FIG. 33 is a fragmentary top-plan view, illustrating one possibility of arranging a plurality of dot-printing elements relative to a carrier therefor.

FIG. 33 shows, in a diagrammatic top-plan view, how a large number of individual ones of the elements 1 may be arranged over the width of the respective beam 2. The elements 1 may be so offset relative to one another that in effect every single square millimeter of a web 1 to be printed can be provided with color dots. Of course, the illustration in FIG. 33 should not be considered limiting, inasmuch as other arrangements, and larger or smaller numbers of elements 1, can be provided on each beam, or on different beams.

Figure 35:
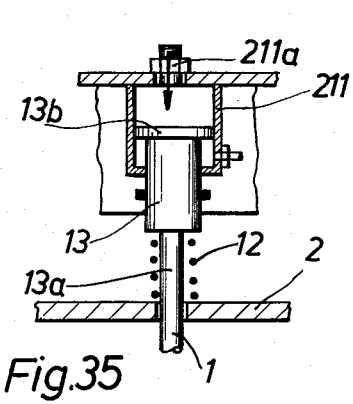
FIG. 35 is a fragmentary vertical section, illustrating a different possible arrangement for controlling the printing elements.
Figure 34:
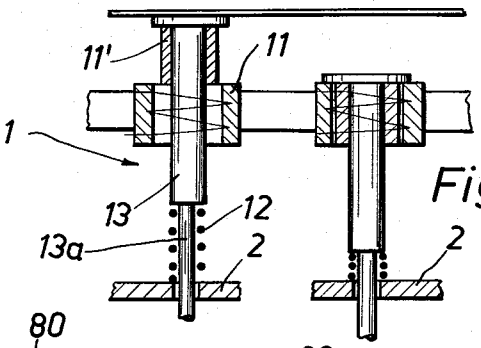
FIG. 34 is a fragmentary vertical section, illustrating an arrangement for controlling the printing elements.
Figure 36:
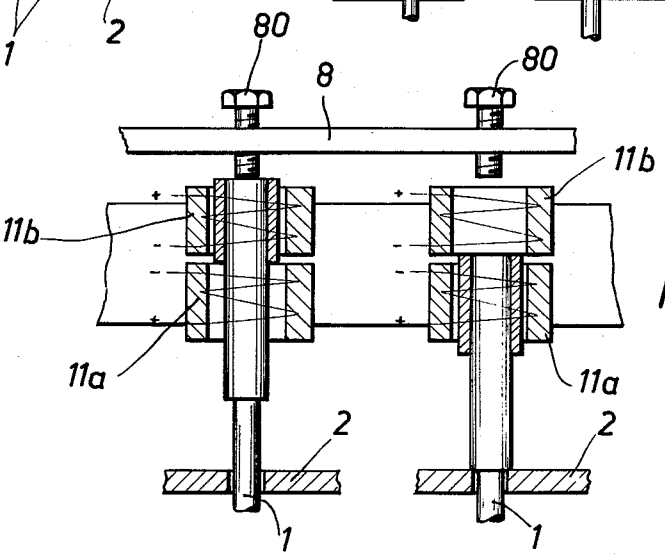
FIG. 36 is a further diagrammatic vertical section illustrating another possibility of controlling the printing elements.

Finally, FIGS. 34–36 show how individual ones of the elements 1 can be controlled. These are again only exemplary possibilities.

FIG. 34 shows that the elements 1 may be controlled by means of magnets 11, return springs being provided between an enlarged-diameter portion 13 of the respective element 1 and a supporting plate or the upper surface of the beam 2. Each element 1 here is in form of the portion 13*a* which receives and yields up the printing ink, at the portion 13. The magnets 11 are electromagnets and when the coil of the electromagnet is energized it attracts the armature 11′ thereof, moving the element 1 downwardly as shown at the right-hand side of FIG. 34. When the coil is deenergized the spring 12 restores the element 1 upwardly, as shown at the left-hand side of FIG. 34.

FIG. 35 shows a control by pneumatic means, a restoring spring 12 again being provided as before, and the element 1 also being constructed essentially the same as in FIG. 34. The upper end 13*b* of the portion 13 acts as a piston in a cylinder 211 into which compressed air can be admitted via the inlet 211*a*. This causes the element 1 to move downwardly, and when the admission of compressed air is terminated the spring 12 restores it to its upper end position.

FIG. 36 shows how the members 1 can be controlled via two electromagnets, i.e. two solenoids. The left-hand side of FIG. 36 shows the electromagnet 11*b* in operative position whereas the magnet 11*a* is in the inoperative position, whereas at the right-hand side of FIG. 36 the electromagnet 11*a* is shown in operative position. A support 8 is provided with abutment screws 80 which determine the upper end position of the elements 1. Since one of the magnets effects downward movement of the element 1 and the other magnet effects upward movement of the element 1 to rest position, the spring 12 of FIGS. 34 and 35 is omitted in FIG. 36.

The control of the electromagnets or of the compressed air cylinder 211 or other control means that might be utilized in lieu of them, is effected via a control unit St, for example a computer. Each individual element 1 is individually selected during each stroke of the associated beam 2, or during each operating cycle in the embodiment of FIGS. 5 and 5*a* where the beams 2*a* are stationary, so that a change in the pattern to be printed can be effected — if desired — after printing any single one of a series of webs 3, or after printing a small number of such webs, without requiring any particular operations other than a change in the programming of the unit St.

This programming can be controlled by means of punch cards or magnetic tapes, or in any other way known for such controls. For example, the type of controls used for controlling jaquard machines can be employed to effect the control and produce a new pattern for each individual web passing through the machine. The production of magnetic tapes or punch cards or punch tapes can be carried out by means of pattern computers which are available commercially from various suppliers.

It should be understood that the improved apparatus is susceptible of various modifications without departing in any way from the sense and intent of the invention. Thus, the elements 1 may for instance penetrate into or even penetrate through the base fabric 30 of the web 3. The web may be stationary and the beam may be shifted lengthwise and/or transverse of the web until the entire pattern is printed. This may for instance be advantageous if the web is an area rug. Of course, conversely the beam may remain stationary and the web may move, as described earlier. The selection of the particular type of element 1 to be used, i.e. the ones which are provided with ink-receiving spaces, such as for example the spaces 10 in FIG. 2, or the ones which have the ink transfer stamp pads shown in FIGS. 30–32, depends upon the type of web to be printed. For a smooth web, the type of element 1 shown in FIGS. 30–32 may be utilized, whereas a high-nap web such as shown for example in FIG. 1 may be better printed by use of one of the types of elements which are shown in FIGS. 2, 22, 24, 26 and 28.

It will be understood that each of the elements described above, or two or more together, may also find a useful application in other types of constructions differing from the types described above.

While the invention has been illustrated and described as embodied in printing of webs, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for printing onto webs, particularly textile webs, comprising support means for supporting a web to be printed in a working plane; mounting means adjacent said support means; a plurality of plunger elements carried by said mounting means in a grid-shaped pattern and each having a free end portion operative for applying a dot of printing medium to a web; moving means for displacing said plunger elements with reference to said web in respective reciprocating cycles during each of which the plunger elements successively assume a retracted position and an advanced printing position in the latter of which the respective free end portion physically contacts said web and applies a dot of printing medium to the same; means for supplying printing medium to be entrained by said plunger elements during the reciprocation thereof; means operable during the respective reciprocating cycles in accordance with a pattern to be printed, for selecting different groupings of individual plunger elements to be displaced to said advanced position by operation of said moving means; and transporting means for effecting movement of at least one of said support means and mounting means relative to the other one thereof parallel to said working plane.

2. An apparatus as defined in claim 1, wherein each of said elements is formed with a chamber for a quantity of said printing medium.

3. An apparatus as defined in claim 1, wherein said elements are hollow needles which introduce printing medium into the web.

4. An apparatus as defined in claim 1, wherein said elements are applicators the end portions of which are adapted to stamp a dot of said printing medium onto the web.

5. An apparatus as defined in claim 1, wherein said elements each have a longitudinal axis, said moving means being operative for shifting said elements lengthwise of the respective axis toward and away from a web and wherein said support means extends across said web, said elements having free ends located substantially in the plane of said web upon said elements being moved towards said web.

6. An apparatus as defined in claim 5, wherein said moving means further comprises a drive for raising and lowering said support means relative to said web.

7. An apparatus as defined in claim 6, said moving means further comprising means for raising and lowering said elements relative to said support mean.

8. An apparatus as defined in claim 1; wherein said transmitting means transports a web in a path; and wherein said elements are located above said path.

9. An apparatus as defined in claim 8, wherein said transporting means comprises a printing blanket.

10. An apparatus as defined in claim 8, wherein said transporting means comprises a continuously operating transporting device.

11. An apparatus as defined in claim 8, wherein said transporting means comprises an intermittently operating transporting device.

12. An apparatus as defined in claim 1, wherein said support means comprises a plurality of supports on each of which some of said elements are mounted and which are movable relative to a path in which a web to be printed travels, some of said supports being connected for movement relative to said path in unison with one another.

13. An apparatus as defined in claim 12, said moving means comprising a control unit for controlling the movement of respective ones of said elements.

14. An apparatus as defined in claim 13 wherein said control unit is a punch-card operated control unit.

15. An apparatus as defined in claim 13, wherein said control unit is a punched-tape control unit.

16. An apparatus as defined in claim 13, wherein said control unit is a magnetic-tape control unit.

17. An apparatus as defined in claim 13, wherein said control unit is an electronic computer.

18. An apparatus as defined in claim 1, wherein said moving means comprises for each element a spring biasing the element to said retracted position and electromagnetic means for moving the element to said printing position counter to the action of said spring.

19. An apparatus as defined in claim 18; and further comprising adjustable abutment means for limiting the movements of said elements between said positions.

20. An apparatus as defined in claim 19, wherein said adjustable abutment means comprises abutment screws.

21. An apparatus as defined in claim 1, wherein said moving means comprise hydraulic cylinder means for each of said elements and operative for moving the same to said printing position.

22. An apparatus as defined in claim 1, wherein said support means comprises a support on which said elements are mounted, said moving means displacing said support towards and away from a major surface of said web.

23. An apparatus as defined in claim 22, wherein said moving means comprises rotary cam means operatively connected with said support for displacing the same towards and away from said major surface.

24. An apparatus as defined in claim 23, wherein said moving means further comprises connecting rods connected to said support and to said cam means so as to effect the displacement of said support in response to rotation of said cam means.

25. An apparatus as defined in claim 22, wherein said moving means comprises rotary crank means and crank linkage means connecting said crank means with said support.

26. An apparatus as defined in claim 1, wherein said support means comprises a support having spaced end portions, said elements being mounted on said support; said moving means displacing said support towards and away from a major surface of said web; and guide means at said end portions for guiding said support during displacement thereof.

27. An apparatus as defined in claim 1, wherein said support means comprises a support on which said elements are mounted, said support having an interior printing-medium chamber and a wall in part bounding said chamber and provided with openings facing said web and being aligned with the respective elements for travel of the same therethrough.

28. An apparatus as defined in claim 27, each element having a part which in said retracted position is located in one of said openings and seals the same.

29. An apparatus as defined in claim 27; wherein said means for supplying printing medium includes means for maintaining substantially constant pressure in said chamber.

30. An apparatus as defined in claim 1, wherein said supplying means comprises a printing medium reservoir; and means for inserting said elements into and withdrawing them from said reservoir.

31. An apparatus as defined in claim 30, said reservoir having an upper open side and a wall overlying said upper side and formed with apertures for insertion of said elements into and withdrawal from said reservoir.

32. An apparatus as defined in claim 31, wherein said apertures are so dimensioned that excess printing medium is stripped from said elements during withdrawal thereof through said apertures.

33. An apparatus as defined in claim 1, wherein said support means comprises a support carrying said elements and movable toward and away from a major surface of said web; a reservoir of printing medium; and means for cyclically moving said reservoir of printing medium into and out of the path of said support intermediate successive contacts of said elements with said web.

34. An apparatus as defined in claim 1, wherein said support means comprises a support carrying said elements and being movable towards and away from a major surface of said web; a reservoir of printing medium laterally of said support, said support being cyclically movable in a sequence in which respective ones of said elements first dip into said reservoir and thereupon print on said web.

35. An apparatus as defined in claim 1; said transporting means comprising a printing blanket for supporting said web; and advancing means for stepwise advancing said printing blanket and thereby the web thereon.

36. An apparatus as defined in claim 35; and further comprising coordinating means for coordinating the advancement of said printing blanket with the movements of said elements.

37. An apparatus as defined in claim 1, wherein said elements are each provided with spaces for intermittently accommodating a quantity of printing medium which is to be printed on said web.

38. An apparatus as defined in claim 37, wherein said elements are of substantially rod-shaped configuration and said spaces are axially extending grooves formed in the respective elements.

39. An apparatus as defined in claim 37, wherein said elements are of substantially rod-shaped configuration and said spaces are axially extending slots formed in the respective elements and each open at two diametrally opposite sides of the respective element.

40. An apparatus as defined in claim 37, wherein said spaces extend axially of the respective elements and each have a length corresponding to the maximum depth of a nap on a textile web which is expected to be printed.

41. An apparatus as defined in claim 37, wherein said free end portions face towards said web and are of solid cross-section.

42. An apparatus as defined in claim 37, wherein said free end portions face said web and taper in direction towards the same.

43. An apparatus as defined in claim 37, wherein said elements are tubular and have opposite end portions, at least one of which is provided with printing-medium ports.

44. An apparatus as defined in claim 43, said one end portion being a rear end portion, and said elements each further having a circumferential wall formed with at least one axial slot communicating the interior of the respective element with the exterior thereof.

45. An apparatus as defined in claim 37, wherein each free end portion faces said web and is cut off at an angle to the elongation of the respective element.

46. An apparatus as defined in claim 37; said support means comprising a support on which said elements are mounted, said support having an interior printing-medium chamber in part bounded by a wall facing said web and formed with openings for passage of said elements therethrough to the exterior of said chamber, said elements each having upwardly of said spaces a portion of solid cross-section which is located in respective openings and seals the same against outflow of printing medium.

47. An apparatus as defined in claim 1, wherein said elements each have a leading end; and further comprising a plurality of pads adapted to be inked with printing medium, said pads each engaging one of said leading ends for transfer of printing medium thereto inbetween the movements of said elements to a position in which they print onto said web.

48. An apparatus as defined in claim 47; said support means comprising a support for said elements and provided with bores through which the respective elements pass during the movements thereof to said printing position; said pads being pivotally mounted laterally of the outlet ends of the respective bores and normally overlying said outlet ends so as to be contacted by the leading end of an element moving through the respective bore.

49. An apparatus as defined in claim 48, said support having an internal chamber for inking medium, and a plurality of inking passages each laterally adjacent one of said bores and communicating said chamber with the respective pad when the latter is in position against the outlet of the bore.

50. An apparatus as defined in claim 48; and further comprising biasing means permanently biasing said pads against the respective outlet ends.

51. An apparatus as defined in claim 1, wherein said elements are arranged in laterally spaced rows.

52. An apparatus as defined in claim 51, wherein the elements of each row are staggered with reference to the elements of adjacent rows.

53. An apparatus as defined in claim 1, wherein said elements each have a longitudinal axis; said support means comprising stationary support means extending across said web and mounting said elements for movement towards and away from said web; said moving means being operative for moving said elements relative to said stationary support means towards and away from said web.

* * * * *